United States Patent [19]

Humphrey

[11] Patent Number: 4,541,636

[45] Date of Patent: Sep. 17, 1985

[54] FLUID PRESSURIZED ARROW SHAFT FOR ARCHERY ARROWS

[76] Inventor: Stanley A. Humphrey, 2621 Oak Park Ave., Minneapolis, Minn. 55411

[21] Appl. No.: 706,120

[22] Filed: Feb. 27, 1985

[51] Int. Cl.[4] ..... F41B 5/02

[52] U.S. Cl. ..... 273/416

[58] Field of Search ..... 273/416, 419, 420, 421, 273/422

[56] References Cited

U.S. PATENT DOCUMENTS

| | | | |
|---|---|---|---|
| 1,989,847 | 2/1935 | Cowdery | 273/416 |
| 3,586,332 | 6/1971 | Alban | 273/416 |
| 4,410,183 | 10/1983 | Miller | 273/416 |

*Primary Examiner*—Paul E. Shapiro

*Attorney, Agent, or Firm*—Clayton R. Johnson

[57] ABSTRACT

An archery arrow having an elongated hollow shaft with a nock mounted on the rear end thereof and a front end that mounts an internally threaded broadhead or arrow point insert. An arrow broadhead or point is threaded into the insert bore to extend forwardly of the shaft while a rubber seal member is mounted by the insert to extend rearwardly thereof and within the shaft. The nock and insert are in fluid sealing relationship with the shaft while the seal member, nock and shaft define a fluid chamber extending between the nock and seal member. The seal member permits a needle point being extended thereinto to permit pressurized fluid passing into the above mentioned chamber. In the first and third embodiments the needle point extends axially through the seal member while in the second embodiment the needle point is extended only part of the axial distance through the seal member so that the fluid flows through cross passages to an annular chamber bound by the seal member and shaft and then axially between adjacent surface parts of the shaft and seal member to pressurize the shaft rearwardly of the seal member. In each of the embodiments, the pressurization of the shaft makes the shaft more rigid and thereby less subject to bending.

27 Claims, 12 Drawing Figures

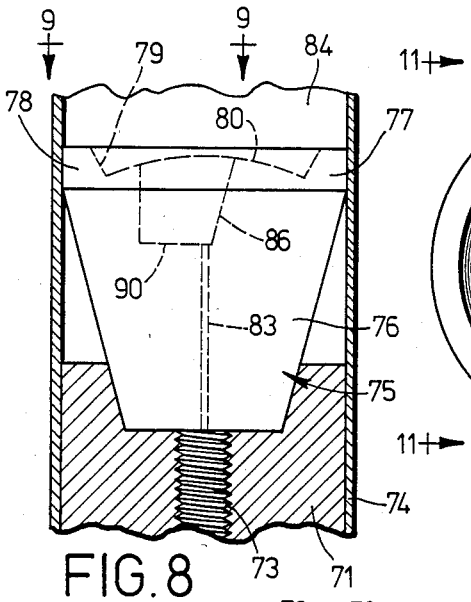
FIG. 8
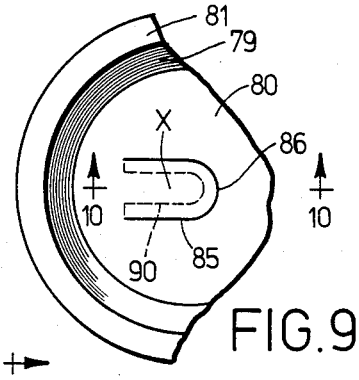
FIG. 9
FIG. 10
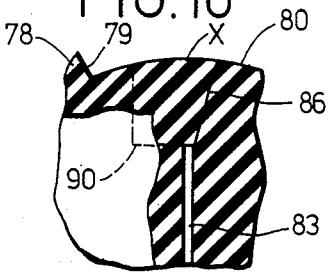
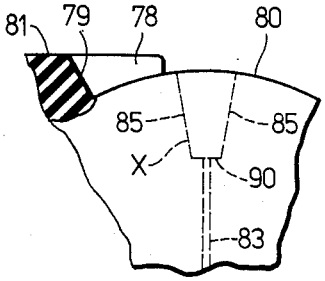
FIG. 11
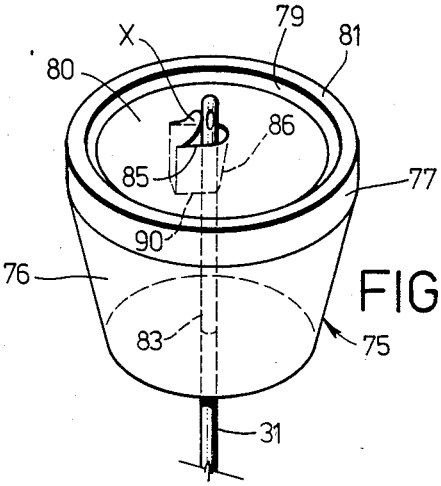
FIG. 12

FLUID PRESSURIZED ARROW SHAFT FOR ARCHERY ARROWS

BACKGROUND OF THE INVENTION

An archery arrow having a nock, a hollow shaft, an arrow point and an insert for removably mounting the point to extend forwardly of the shaft.

In using prior art arrows when the bowstring is released to shoot an arrow the arrow flexes or bends one way, thence straightens out and may repeat the bending and straightening although with progressively smaller magnetudes of bending. Also some shafts are slightly bent even when not being shoot. This results in decreased accurracy in shooting. To minimize this bending more expensive alloys can be used which undesirably increase the costs of manufacture. Also hollow shafts having greater wall thickness or shafts having larger inner and outer diameters can be used but this results in an undesirable increase in weight of the arrow.

In order to obtain a stiffer (less subject to bending) straighter arrow with no or only a relatively small increase of weight, or using more expensive alloys, this invention has been made.

SUMMARY OF THE INVENTION

An archery arrow having an elongated hollow shaft, a nock mounted by the shaft rear end portion in fluid sealing relationship therewith, an insert having a bore extending axially therethrough mounted in the shaft front end portion, an arrow point removably mounted by the insert to extend forwardly of the shaft, and a rubber fluid seal member mounted by the insert and within the shaft to permit a needle being extended thereinto for discharging fluid fluid under pressure to flow to the first chamber in the shaft axially between the nock and the seal member for pressurizing the shaft to straighten the shaft and make it more rigid. Advantageously the shaft and the seal member alone or in combination with the insert provide an annular second chamber axially intermediate the opposite axial ends of the seal member, the seal member having an axial passage opening to the insert bore and a radial passage for conducting fluid from the axial passage to the second chamber so that when the fluid pressure in the radial passage is sufficiently higher than in the first chamber fluid will flow through the radial passage to the second chamber and then axially between a rear part of the seal member and shaft to the first chamber but when the fluid pressure in the second chamber is lower than that in the first chamber the seal member prevents fluid flow from the first chamber to the second chamber.

One of the objects of this invention is to provide new and novel means in an archery arrow for making the metal arrow shaft straighter and more rigid without increasing the transverse dimension of the shaft, nor the amount of metal used in the shaft, nor have to use special more expensive metal alloys for making the shaft. Another object of this invention is to provide new and novel means on a hollow archery arrow shaft for providing a sealed fluid chamber in the shaft that extends at least a major of the length thereof while permitting the flow of fluid under pressure through a needle point and being discharged to flow into said chamber.

A further object of this invention is to provide in a hollow archery arrow shaft that is sealed at one end and has an insert with a bore extending axially therethrough for removably mounting an arrow point, new and novel means that a sealed first chamber is formed between said on end and said means and in combination with the shaft alone or together with the insert forms an annular second chamber to permit fluid flow from the second chamber to the first chamber when the pressure in the second chamber is higher than that in the first chamber and prevent fluid flow from the first chamber to the second chamber when the fluid pressure in the first chamber is higher than that in the second chamber. In furtherance of the last mentioned object it is a still further object of this invention to provide fluid seal means of a construction to permit a needle point being extended axially therethrough for applying fluid under pressure to the first chamber without passing through the second chamber and block discharge of fluid under pressure from the first chamber when the needle point has been withdrawn. Also in furtherance of the next to last mentioned object, it is still another object of this invention to provide fluid sealing means of a construction to in conjuction with only the shaft or in combination with the shaft and insert form an annular second chamber and a fluid passageway that at one end opens to the insert bore and at the opposite end to the second chamber whereby fluid under pressure is applied to the first chamber only by first passing through the second chamber, and thence between the shaft and the sealing means when the fluid pressure in the passageway is higher than that in the first chamber.

BRIEF DESCRIPTION OF THE DRAWINGS

FIG. 8 is a fragmentary view of the third embodiment of the invention that shows a side view of the seal member thereof and the adjacent parts of the shaft and insert in cross section;

FIG. 9 is a fragmentary view of the seal member of the third embodiment that is generally taken along the line and in the direction of the arrows 9—9 of FIG. 8;

FIG. 10 is a fragmentary view of the seal member that is in part a side view and in part a cross sectional view generally taken along the line and in the direction of the arrows 10—10 of FIG. 9;

FIG. 11 is a fragmentary view generally taken along the line and in the direction of the arrows 11—11 of FIG. 9 other than part of the rim is broken away to show the curvature of the partial spherical surface of the seal member; and FIG. 12 is a perspective view of the seal member of the third embodiment with a needle point extended therethrough.

Referring now to FIGS. 1–5, the first embodiment of the invention, generally designated 10, includes an archery arrow having a longitudinally (axially) elongated, hollow metal arrow shaft 11, preferrably made of aluminum that at its rear end mounts a nock 12 in fluid sealing relationship to the shaft. The front end portion of the shaft has an insert 14 mounted therein in fluid sealing relationship therewith, the insert having a central bore 16 extending axially therethrough. The insert bore has an intermediate threaded portion for threadingly mounting the arrow point 13 to extend forwardly of the shaft. Of course a broadhead could be used in place of the arrow point.

Figures 1, 2, 3, 4, 5, 6, 7:
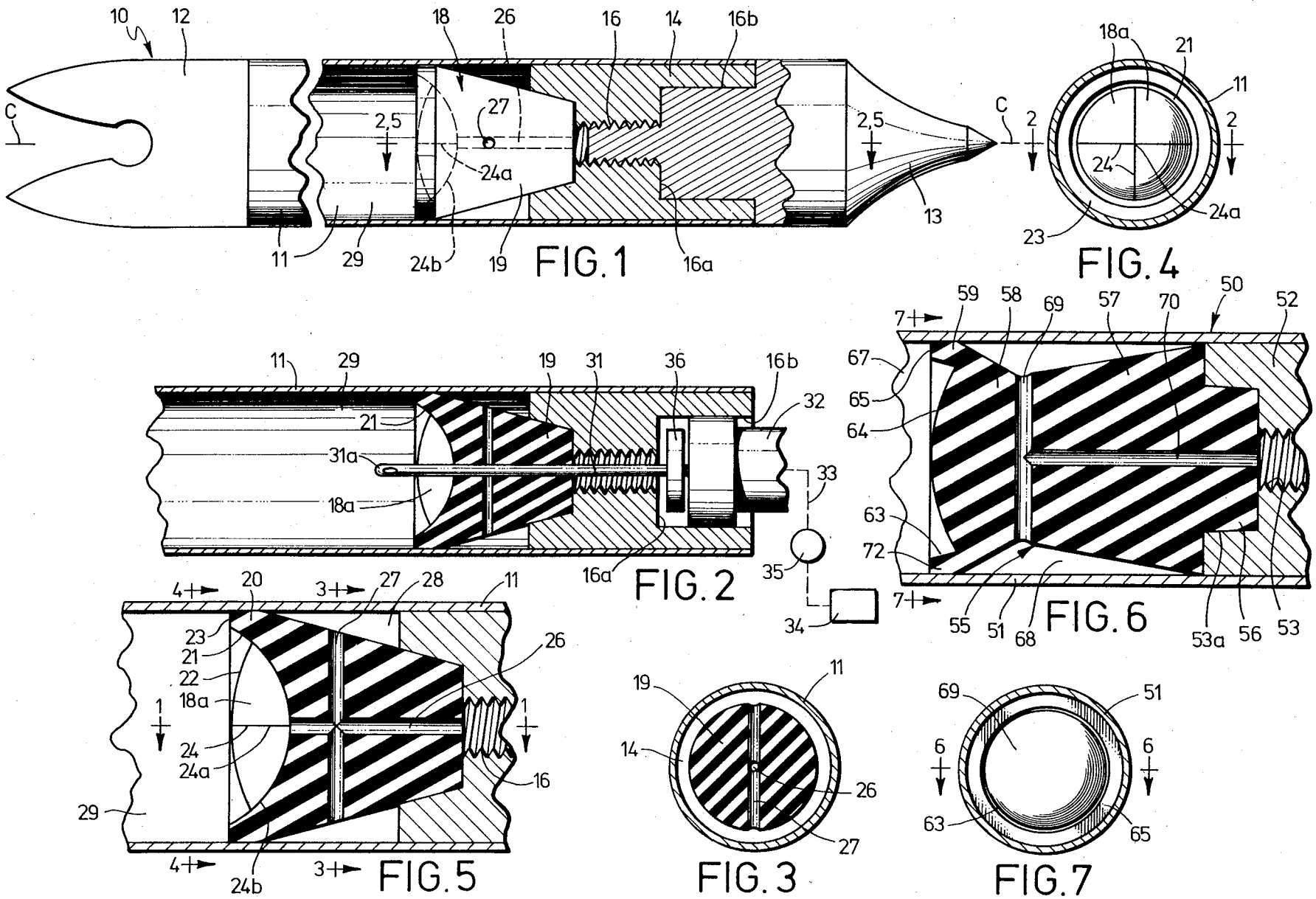
FIG. 1 is a side view of the first embodiment of the archery arrow of this invention with the major portion of the axial intermediate part of the shaft and the vanes not being shown, and the insert and the parts of the shaft and arrow point shown in cross section being generally taken along the line and in the direction of the arrows 1—1 of FIG. 5.
FIG. 2 is a fragmentary longitudinal cross sectional view of part of the structure shown in FIG. 1 that is generally taken along the line and in the direction of the arrows 2—2 of FIG. 4 together with showing part of a needle inserted through the seal member for applying fluid under pressure to the fluid chamber in the shaft that is between the nock and seal member and a diagramatic showing of means for supplying fluid under pressure to the needle.
FIG. 3 is a transverse cross section generally taken along the line and in the direction of the arrows 3—3 of FIG. 5.
FIG. 4 is a transverse cross sectional view generally taken along the line and in the direction of the arrows 4—4 of FIG. 5.
FIG. 5 is an enlarged cross sectional view of part of the structure shown in FIG. 2 other than no needle point is extended into the shaft.
FIG. 6 is a longitudinal cross sectional view corresponding to FIG. 5 other than it is of a second embodiment of the invention, said view being generally taken along the line and in the direction of the arrows 6—6 of FIG. 7.
FIG. 7 is a transverse cross sectional view generally taken along the line and in the direction of the arrows 7—7 of FIG. 6.

The wall portion of the insert defining the rear part of bore 16 is of a frusto conical shape for receiving and having the rear part of the frusto conical portion 19 of a rubber seal member (valve), generally designated 18, extended therein with the seal member adhered thereto in fluid sealing relationship with the insert. As may be noted in the drawing the frusto conical portion 19 is tapered to be of increasing diameters in a rearward direction with the major base thereof being of substantially the same diameter as the inner diameter of the shaft. The seal member also includes a cylinderical portion 20 that is integrally joined to portion 19 to extend rearwardly thereof. The cylindrical portion is provided with a rearwardly opening recess that is defined by surfaces 21, 22; surface 21, the radially adjacent part of the radially outer perpheral wall of the cylindrical portion and the transverse planar annular end surface 23 defining a rim that is of an axial length less than the axial length of the cylindrical portion. The rim portion is integrally joined to the part of the seal member that extends axially forwardly thereof. The outer diameter of the cylindrical portion is such to form a tight sealing fit with the inner peripheral wall of the shaft.

The inner peripheral surface 21 of the rim from its juncture with the annular surface 23 of the rim is of progressively increasing diameters in a forward axial direction to its axially inner edge where it joins to the radially outer edge of the spherically curved transverse surface 22 of the seal member. Surface 22 is curved to open forwardly with the part thereof extending the fartherest axially rearwardly being at or substantially at the central axis C—C of elongation of the shaft and the juncture of surface 22 with surface 21 defining a circle having its radius of curvature eminating from said central axis of the shaft. The surface 22 in an axial plane containing the central axis C—C is curved through an arc substantially less than 180° while its radius of curvature is greater the radius of curvature of the outer peripheral wall of the shaft.

Preferrably two diametric slits 24 are provided in the rear portion of the seal member to extend at right angles to one another to intersect one another along a line 24*a* that extends axially and located along the central axis of the shaft. The axial length of each slit varies in a radial direction, the distance each slit extends forwardly in the seal member being indicated by lines 24*b* (see FIGS. 1 and 5). The forward edge 24*b* of each slit 24 is arcuately curved to open in a rearward direction and extends progressively further rearwardly in each radial direction from the intersection 24*a* of the slits. Each slit extends radially to adjacent to the juncture of the surface 21 with surface 22 but is radially spaced from the outer peripheral surface of the rim 20 and is of a maximum axial dimension that is greater than the corresponding axial dimension of rim 20. Thus the slits provide four seal portions 18*a* that are joined to the axially adjacent part of the seal member and the radially adjacent part of the seal member. The maximum axial dimension of each of the seal member portions is greater than the corresponding axial dimension of the cylindrical portion 20 and extends a substantial distance forwardly thereof.

The seal member has a seal member bore 26 having a central axis of elongation coextensive with the central axis C—C of the arrow shaft that at its front end opens to the insert bore 16 and at its rear end opens to seal member portions 18*a* at the juncture of lines 24*a*, 24*b*. Axially intermediate the seal portions 18*a* and the front planar surface of the seal member there is provided a transverse bore 27 that extends diametrically across the seal member to intermediate its opposite ends open to the annular chamber 28, radially intermediate its opposite ends open to the axial bore 26, and being located a substantial distance axially forwardly of the lines 24*b*. Thus the bore 27 is axially intermediate the rim 20 and the rear planar surface of the insert, and axially intermediate the forwardmost part of seal portions 18*a* and the rearwardmost part of the insert. The chamber 28 is defined by the inner peripheral wall of the shaft 11, the radially outer peripheral surface of the seal member and the rear planar surface of the insert.

The seal member, which only has its rim portion abutting a against the inner peripheral wall of the shaft, the front part of the nock and the inner peripheral wall of the shaft axially between the seal member and nock provide a fluid pressure chamber 29 which extends nearly the length of the shaft. That is surfaces 21, 22, 23 define the front end of chamber 29.

In using the invention there is provided a needle having an elongated needle point 31 (see FIG. 2) that opens to one end of a needle barrel 32, the other end of the barrel being fluidly connected by a line 33 to a source of gas under pressure 34. A shut off valve 35 is provided in the line 33. The needle includes a stop 36 that is abuttable against an insert shoulder 16*a* (provided by the intersection of the front end of the threaded portion of the insert bore and the enlarged diametric front end portion 16*b* of the bore) to limit the movement of the needle point in a rearward direction within the shaft 11. The needle point is of an axially length to extend into the chamber 29 a little prior to the stop 36 abutting against the shoulder 16*a*. Further the needle point is of a diameter to from a close fit with the inner peripheral wall of the seal member that defines bore 26.

In order to pressurize the rear chamber 29, the arrow point is disconnected from the insert. Then with the valve 35 closed the needle barrel is manually moved to push the needle point 31 into and through bore 26 and rearwardly of the bore 26. As the needle point engages the front parts of the seal portions 18*a*, it pushes their apex portions (corner portions adjacent lines 24*a*) slightly rearwardly and away from one another to permit the terminal tip 31*a* of the needle point being moved into chamber 29 while apex portions yield enough to still form a fluid seal between them and the radially adjacent part of the needle point. Now the valve 35 is opened to permit pressurizing chamber 29, preferrably a guage (not shown) being provided to continuously measure the pressure in the line 33. Preferrably the chamber 29 is pressurized to about 80 psi to 120 psi with helium although other gases such as dry air or nitrogen can be used.

As the chamber 29 is pressurized the seal member is slightly axially compressed, the rim portion being urged to expand radially outwardly to form a higher pressure fluid seal with the shaft and the seal portions 18*a* being urged to expand radially to provide a higher pressure fluid seal between them to prevent leakage through the slits and between the seal portions 18*a* and the needle point. After chamber 29 has been pressurized to the desired pressure the needle is slowly withdrawn with the valve still on. As the terminal tip is removed forwardly of the axial rearward surface of seal portions 18*a* adjacent to the line 24, the seal portions radially expand to fill in the space vacated by the needle point. As the terminal tip 31*a* has been moved slightly forwardly of the intersection of bores 26, 27, the pressurized gas flows into the annular chamber 28. In the event the pressure in chamber 28 becomes somewhat greater than that in chamber 29, the rim portion will yield to permit passage of the pressurized gas between the rim portion and the shaft inner peripheral wall from chamber 28 to chamber 29. As the needle terminal tip 31*a* is moved forwardly out of bore 26 the pressurized gas in chamber 28 vents through bores 26, 27, and if there was any fluid flow from chamber 28 to chamber 29, the rim portion expands radially to block such fluid flow between the seal member and the shaft. The valve is turned off and the arrow point is replaced.

By pressurizing the chamber 29, the arrow becomes more rigid and straighter with much less bending when shoot while the weight of the arrow is not increased as much as would occur by making the arrow shaft of a greater wall thickness or of a larger diameter. This increase of rigidity is thus obtained without the use of special alloys which would increase the cost of making the arrow above that by the use of this invention. By providing the increase of rigidty greater accuracy is obtained.

In the event valve 35 is closed prior to beginning the withdrawal of the needle, when the terminal tip has been withdrawn to be in fluid communication with the bore 27, the pressure in the needle drops as the gas therein can expand into chamber 28.

It is to be understood that instead of two slits that extend diametrically between the juncture of surfaces 21, 22, there could be provided, for example 3 or 5 slits that extend radially between the juncture of surfaces 21, 22 and the central axis of the seal member to intersect along their axial lengths at said central axis.

Referring now to FIGS. 6 and 7, the second embodiment of the invention, generally designated 50, is the same as the first embodiment other than the seal member and possibly the shape of the portion of the insert bore into which the seal member extends. That is the arrow of the second embodiment includes a hollow arrow shaft 51, a nock (not shown) mounted on the rear end of the shaft in fluid sealing relationship therewith, an insert 52 mounted in and adhered in fluid sealing relationship to the front end of the shaft and having a bore 53 extending axially therethrough, an arrow point (not shown) mounted by the insert 52 in the same manner as disclosed relative to the first embodiment, and a gas rubber seal member (valve), generally designated 55.

The rear portion 53*a* of the insert bore 53 is of a frusto conical shape for receiving and having the rear frusto conical portion 56 of the seal member adhered thereto in fluid sealing relationship. A front axially intermediate frusto conical portion 57 of the seal member has its major base integrally joined to the major base of the portion 56. The major base of the portion 57 is of a greater diameter than portion 56, portion 57 having an annular surface abutting against the rearwardmost annular surface of the insert and advantageously adhered thereto in fluid sealing relationship therewith.

An axially rear intermediate frusto conical portion 58 has its minor base integrally joined to the minor base of the front intermediate frusto conical portion 57 to extend axially rearwardly thereof, the minor bases of portions 57, 58 being coextensive of one another. The axial length of the rear intermediate portion 58 is much shorter than the axial length of portion 57. The major bases of portions 57, 58 are of the same or only a slightly greater diameters than the inner diameter of the shaft.

Integrally joined to the major base of the rear intermediate portion 58 to extend rearwardly thereof and being of the same outer diameter as the major base diameter thereof is a cylindrical portion 59 for forming a fluid seal with the inner peripheral wall of the shaft. The axial length of the cylindrical portion is many time less than the axial length of portion 57. The cylindrical portion has a rearwardly, radially centered recess that is defined by seal member wall portions to provide a rim 72 having a frusto conical surface 63 that has its major base intersecting the transverse (rear) annular rim edge 65 of the seal member, and partial spherical surface 64 that subtends a minor part of the surface of a sphere. The juncture of the minor base of surface 63 and surface 64 is circular.

The seal member, the nock and the part of the shaft extending axially between the seal member and nock provide a rear chamber 67 for containing a pressurized gas and extends the major portion of the length of the shaft. Depending upon whether or not the axial front part of the peripheral surface of the frusto conical portion 57 forms a fluid seal with the shaft, the shaft inner peripheral wall, and the frusto conical surfaces of the front and rear intermediate frusto conical portions alone or in combination with part of the insert define an annular chamber 68 that is closed other than for the transverse bore 69 that extends diametrically across the seal member to at each end open to chamber 68. Preferrably the bore 69 opens to chamber 68 axially adjacent the intersection of the front and rear frusto conical portions 57, 58. An axially extending bore 70 is provided in the seal member to preferrably have its central axis extend coextensive with the shaft central axis, and at one end opens to the transverse intermediate part of bore 69 and at its other end opens to insert bore 53. The portion of the seal member rewardly of bore 69 is imperforated and as a result the needle point can not be pushed rearwardly of bore 69.

In order to pressurize the second embodiment the arrow point is removed from insert 52, the needle point pushed into bore 70 to have its terminal tip 31*a* located axially between the opposite ends of bore 70, and the valve 35 opened. It is to be noted that the wall defining bore 70 forms a sufficiently tight fit with the needle point that no or very little gas under pressure flows between the bore wall and the needle point into the insert bore. The gas under pressure flows through bore 69 into chamber 68 and when it is at a sufficiently higher pressure than the gas in chamber 67 causes the rim portion 72 to yield so that the gas flows between the rim portion and the inner peripheral wall of the shaft into chamber 67. When the guage (not shown) in line 33 indicates the pressure in chamber 68 is sufficiently high to obtain the desired pressurization of chamber 67 the needle point is withdrawn from bore 70, the pressure in the annular chamber 68 returns to that of the ambient atmosphere and the pressurized gas in the rear chamber 67 forces the seal member to be compressed to form a fluid seal at its rim portion with the shaft inner peripheral wall to prevent gas flow from chamber 67 to chamber 68. Thereafter the arrow point is again threaded into the insert bore.

Referring now to FIGS. 8–12, the third embodiment of the invention, generally designated 70, includes an insert 71 mounted in a shaft 74 in the same manner described in respect to the first embodiment and advantageously being of the same construction as the corresponding members of the first embodiment. The gas rubber seal member (value), generally designated 75, of the third embodiment advantageously is of the same shape as that of the first embodiment and mounted in the rear frusto conical part of the insert bore 73 in the same manner. That is the seal member 75 includes a frusto conical portion 76 mounted by the insert to extend rearwardly thereof and a cylindrical portion 77 integrally joined to portion 76 to extend rearwardly thereof and form a fluid seal with the shaft inner peripheral wall.

Cylindrical portion 77 has a rearwardly radially centered recess that is defined by seal member wall portions to provide a rim 78 having a frusto concial surface 79 that has its major base intersecting the transverse (rear) annular rim edge 81 of seal member and a partial spherical surface 80 that subtends a minor part of the surface of a sphere. The juncture of the minor base of surface 79 and surface 80 is circular.

The seal member has an axially extending bore 83 that preferrably has its central axis coextensive with the shaft central axis, and at one end opens to the insert bore and has its opposite end located (terminates) forwardly of the axially adjacent part of the partial spherical surface 80. However the seal member 75 does not have any transverse bore such as disclosed for the first and second embodiments.

In order to permit the needle point extending through the rear part of the seal member and into the rear chamber 84 of the shaft (corresponding to rear chamber 29 of the first embodiment), the seal member has a closure X. The closure portion X is defined by a slit that provides transversely spaced closure edges 85 that converge toward one another in an axial forward direction and an arcuately curved closure web edge 86 that is of progressively decreasing radii of curvature in transverse planes in a forward direction. Thus the intersection of the slit with the partially spherical surface is such as shown in a solid line in FIG. 9 while the axial inner end of said slit is designated 90 and shown in dotted lines in said Figure. The angle of taper of the slit to the vertical in a forward direction advantageously may be about 5°–20°.

The slit extends axially inwardly from the partial spherical surface 80 and along its length extends further axially forwardly than the cylindrical portion 77. Futher the transverse intermediate part of web edge 86 intersects the rearwardmost part of the seal member bore 83. In the plane of the central axis of the shaft that is mid-way between the edges 85, the edge 86 is intersected thereby along a line that in a rearward direction extends predominently axially rearwardly in a direction radially away from said axis while the edges 85 extend transversely in the opposite direction from the central axis and are spaced from said plane as partially shown by FIGS. 10 and 11. The closure is integrally joined to the remainder (main body) of the seal member throughout the axial length thereof transversely opposite the web edge, and to the adjacent part forwardly of the front end of slit. The forward end of the slit throughout the transverse dimension of the slit is adjacent a transverse plane perpendicular to the shaft central axis which passes through the rear terminal end of the seal member bore. The maximum transverse spacing of edges 85 (at the intersection of the slit with surface 80) in a direction perpendicular to said plane of the central axis is preferrably less than ½ the radius of the circle defined by the intersection of surface 80 and the rim as is the maximum transverse length of the closure.

When the rear chamber of the third embodiment is to be pressurized the arrow point is removed and the needle point is extend through the insert bore to engage the closure member at the intersection of edge 86 and bore 83. Pushing the needle point further rearwardly results in the closure member resiliently yielding transversely and bulging axially rearwardly together with yielding of the main body whereby the needle point can extend into the rear chamber, i.e. extend through the seal member as indicated in FIG. 12. Now the rear chamber can be pressurized. After the rear chamber is pressurized the needle is withdrawn, and as it is withdrawn the needle point urges the adjacent part of the closure to return to its closed, sealing position. This in conjunction with the pressurized fluid in the chamber and the resilient urging of the main body at its juncture to the closure and where it was contacted by the needle point results in the closure member forming a fluid tight seal with the main body after the needle point is withdrawn from adjacent to the closure. Further due to the taper of the slit, the closure in transverse planes is progressively smaller in a forward direction and the fluid pressure acting on surface 80 forms a tighter seal than if the slit was not tapered (only extended axially).

As to each of the embodiments the maximum inner diameter of the rim portion is many times greater than each of the maximum radial thickness of the rim portion and the maximum axial length of the rim portion. Futher with the second embodiment the major base diameter of the rear frusto conical portion 57 of the seal member can be smaller than the inner diameter of the shaft. As to each of the first and third embodiments the rear frusto conical part of the insert bore can be dispensed with whereby the entire rear surface of the respective insert can be located in one transverse plane with the modified insert bore opening therethrough and the front surface of the seal member adhered to the insert rear planar surface. With the second embodiment the frusto conical portion 56 of the second embodiment can be dispensed with and the entire rear surface of the frusto conical portion 57 adhered to the modified insert rear planar surface to have the front end of the axial bore in portion 57 open directly to the insert bore. Additionally for each of the embodiments the radius of curvature of the respective surface 22, 64, 80 is many times greater than the tapered dimension of surfaces 21, 63 and the corresponding surface of rim 78 respectively, and is greater than the outer diameter of the shaft.

With reference to each of the embodiments in place of the nock forming the rear end of the rear chamber, other suitable means may be provided to close the rear end portion of the shaft.

With each of the embodiments the greater the pressure in chamber 29 or 67 or 84 relative the pressure in the respective annular chamber, the more the seal member is axially compressed, and the greater is the force acting to maintain the axially rear part of the seal member in fluid sealing relationship with the shaft. Further even if the inner peripheral wall of the shaft is not perfectly cylindrical, due to the resilient characteristic of the seal member, when the pressure in the rear chamber is greater than that in the annular chamber, the fluid seal between the shaft and seal member will be maintained.

An advantage of the first and third embodiments over the second embodiment is that the needle point can be extended through the seal member to depressurize the rear chamber.

With each of the embodiments for a conventional arrow having a shaft of a given rigidity, by using this invention the shaft may be made of a smaller wall thickness and/or smaller diameters, provided with a seal member and pressurized to be substantially the same weight or of less weight and having a greater rigidity than that of a conventional arrow. Thus with this invention an arrow of lighter weight but with the same or greater straightness and rigidity can be provided without using special alloys.

With reference to each of the embodiments, in place of mounting the seal member in the front end of the shaft, an insert with a bore extending axially therethrough can be mounted in fluid sealing relationship with the rear end of the shaft for mounting the seal member to extend forwardly thereof to form a fluid seal with the shaft; and the insert in the front end of the shaft can be of a type that the point mounting bore does not extend axially therethrough, or if it does have a bore extended axially therethrough, a plug is mounted in the rear end of the bore in fluid sealing relationship with the insert. The nock can be removably mounted by the insert in the rear end of the shaft (for example, by having a threaded front end portion extended into a bore in the insert), or else an axial bore can be provided in the nock to permit a needle point being extended therethrough and into the seal member as previously described relative to the first and second embodiments. If a nock having a central axial bore extended therethrough is used, the insert in the shaft rear end can be dispensed with and the nock adhered to the shaft in fluid sealing relationship therewith. If an insert is mounted in the shaft rear end the respective seal member minor base is adhered to the insert with the seal member extending forwardly thereof; or if a nock with an axial bore is provided with no insert in the shaft rear end, the seal member minor base end is adhered to the nock to extend forwardly thereof with the seal member axial bore opening to the nock bore. If the seal member is adhered to the nock, advantageously the nock front end portion can be provided with a frusto conical bore portion corresponding to the frusto conical bore portion of the inserts of the first and second embodiments other than such bore portion major base end is forwardly of its minor base.

What is claimed:

1. An archery arrow having an axially elongated hollow shaft that has a central axis of elongation, a front end and a rear end, a nock mounted on the shaft rear end in fluid sealing relationship therewith, an arrow point, an insert mounted by the shaft front end to extend therein in fluid sealing relationship therewith for removably mounting the arrow point to extend forwardly of the shaft, said insert having a bore extending axially therethrough and opening to the shaft interior, and a resilient fluid seal member mounted in the shaft adjacent to the insert for in combination with the shaft and the nock define a first gas chamber that extends at least a major portion of the length of the shaft for retaining gas under a higher pressure than atmospheric pressure in the chamber and permitting selectively applying gas under pressure to flow into said chamber to increase the fluid pressure in the chamber.

2. The arrow of claim further characterized in that the seal member is made of rubber and is joined to the insert to extend rearwardy of the insert.

3. The arrow of claim further characterized in that the shaft has an inner peripheral wall, and that the seal member has an axially rearwardly cylindrical portion resiliently, yieldably maintained in fluid sealing relationship with the shaft inner peripheral wall.

4. The arrow of claim 3 further characterized in that the seal member has a rear transverse surface and a front transverse surface and an axially extending bore that at one end opens through the front surface and an opposite end axially forwardly of the rear surface, said seal member having a main body that includes said cylindrical portion, and closure means integrally joined to the main body for yielding when a needle point is pushed to extend through the seal member bore and rearwardly thereof to permit the needle point being extended into said chamber and resiliently returning to a fluid sealing position when the needle point is moved forwardly of the rear surface.

5. The arrow of claim 3 further characterized in that the shaft inner peripheral wall in combination with at least the seal member provides an annular gas chamber located axially between the insert and the cylindrical portion whereby when the gas pressure in the annular chamber is higher than that in the first chamber the cylindrical portion will yield to permit gas flow between the annular chamber and the first chamber between the cylindrical portion and the inner peripheral wall, and that the seal member has a fluid passage that at one end opens to the insert bore and at the other end to the annular chamber.

6. The arrow of claim 5 further characterized in that the seal member has a rear transverse surface and a front transverse surface, and that the fluid passage includes an axially extending bore that at one end opens through the front surface and an opposite end axially forwardly of the rear surface and a transverse bore that at one end opens to the annular chamber and also opens to the axial bore.

7. The arrow of claim 6 further characterized in that the seal member is imperforated axially between said bores and the rear surface.

8. The arrow of claim 6 further characterized in that the seal member is provided with a plurality of axially and radially extending slits that intersect along an axial line adjacent to the central axis and intersect the rear surface to provide seal portions that are resiliently retained in fluid sealing relationship, the axial bore opposite end opening to the intersection of said slits a substantial distance axially forwardly of the axial rearwardmost part of the rear surface.

9. The arrow of claim 8 further characterized in that the seal member has a recess opening toward the nock to provide the annular rim portion that is located radially more remote from the central axis than said slits, said rim portion having a part of the sea member rear surface.

10. The arrow of claim 6 further characterized in that the cylindrical portion has a radially centered recess opening to the first chamber to provide a radially outer rim portion that has a radially inner, axially forward circular edge, and a spherical portion that is curved about radii eminating from a point on the central axis forwardly of the rear surface to intersect said circular edge, the rim portion and spherical portions in part being defined by said rear surface.

11. The arrow of claim 10 further characterized in that said radii of curvature are of greater dimensions than the radius of curvature of the outer peripheral wall of the shaft.

12. An archery arrow having an axially elongated hollow shaft that has a central axis of elongation, an inner peripheral wall, a front end and a rear end, a nock mounted on the shaft rear end in fluid sealing relationship therewith to close the the rear end of the shaft, an arrow point, and first means mounted by the shaft front end to extend thereinto for removably mounting the point of the shaft to extend forwardly thereof and form a fluid seal with the shaft to selectively permit the shaft being pressurized with a gas to a pressure higher than atmospheric pressure and when pressurized retain the shaft in a pressurized condition.

13. The archery arrow of claim 12 wherein it is adapted to be pressurized by a needle connected to a source of gas under pressure and having a needle point, further characterized in that said first means includes an insert having a bore axially extended therethrough for removably mounting the arrow point, the insert being mounted on the arrow shaft to have the insert bore open into the shaft interior, and a rubber seal member mounted by the insert to extend rearwardly thereof, said seal member having an axially front surface adjacent the insert, an axially rear surface, an axially extending bore having a front end opening through the seal member front surface to the insert bore and a rear end axially forwardly of the seal member rear surface, and second means extending axially rearwardly of the seal member bore for forming a fluid sealing engagement with the shaft inner peripheral wall to in combination with the shaft inner peripheral and nock define a closed chamber extending at least a major portion of the length of the shaft while permitting gas under pressure that is discharged from the needle extended at least partially through the seal member bore flowing into said chamber to pressurize the chamber.

14. The arrow of claim 12 further characterized in that the first means includes an insert mounted by the shaft and having a bore extending axially therethrough for removably mounting the arrow point and valve means located in the shaft to extend rearwardly of the insert for in combination with the shaft inner peripheral wall and the nock form a sealed fluid chamber while permitting the application of gas under pressure for pressurizing said chamber above atmospheric pressure and retaining said chamber in such a pressurized condition, said insert bore opening to the valve means.

15. The archery arrow of claim 12 further characterized in that the first means includes valve means located adjacent the shaft front end in fluid sealing relationship with said wall to in conjunction with the nock and said wall form a fluid chamber chamber extending at least the major part of the length of the shaft and permitting said chamber being pressurized.

16. The archery arrow of claim 15 further characterized in that the first means includes an insert extending within the shaft to extend forwardly of the valve means for mounting the arrow point to extend forwardly of the shaft and permit gas under pressure being applied adjacent the valve means to flow into said chamber.

17. The arrow of claim 12 wherein said means includes a rubber seal member having a cylindrical portion resiliently engaging th shaft peripheral wall to form a fluid seal therewith, said cylindrical portion having a generally spherical curved rear surface that is curved about radii eminating from a point adjacent said axis and forwardly thereof.

18. The arrow of claim 17 further characterized in that said seal member has a plurality of axially and radially entending slits that intersect one another along an axial line adjacent said axis.

19. The arrow of claim 18 further characterized in that said seal member has a front transverse surface and an axially extending bore that at one end opens to the intersection of said slits forwardly of said rear surface and an opposite end that opens through the front surface.

20. The arrow of claim 17 further characterized in that said means includes an insert having a bore extending axially therethrough that removably mounts the arrow point to extend forwardly of the shaft, said insert extending within the shaft and having the seal member joined thereto to extend rearwardly thereof with the insert bore opening to the seal member.

21. The arrow of claim 20 further characterized in that the seal member has a radially outer peripheral surface portion that in conjunction with at least one of the shaft inner peripheral wall and insert forms an annular fluid chamber extending axially forwardly of the cylindrical portion so that when the gas pressure is significantly higher in the annular chamber than in the first chamber the pressurized gas will force the cylindrical portion to yield to permit gas flow from the annular chamber to the first chamber, said gas passage having one end opening to the annular chamber and an opposite end that opens to the insert bore.

22. The arrow of claim 21 further characterized in that the seal member has a frusto conical portion having a major base integrally joined to the cylindrical portion to extend forwardly thereof, a minor base abutting against the insert and a radially outer peripheral surface that includes the previously mentioned outer peripheral surface and that the insert has an annular rear surface that in part defines said annular chamber.

23. An archery arrow adapted to be pressurized by a needle connected to a source of gas under pressure and having a needle point, comprising an axially elongated hollow arrow shaft having a central axis of elongation, an inner peripheral wall, and opposite ends, nock means mounted on one end of the shaft and arrow point means mounted on the other end of said shaft, said nock means and arrow point means in combination with the shaft forming a closed pressurizable chamber extending at least the major portion of the axial length of the shaft, one of said means including a seal member extending in the respective end of the shaft to form a fluid seal therewith to permit the needle point being extended at least partially therethrough to permit said chamber being pressurized above atmospheric pressure with a gas and after the chamber is pressurized and the needle point is withdrawn prevent pressurized gas escaping from said chamber.

24. The arrow of claim 23 further characterized in that the seal member has axial opposite first and second end surfaces, the first end surface in part defining the chamber and the second end surface being axially remote from the chamber, the seal member having an axially extending bore for having one end opening through the second surface and an opposite end that terminates axially between said end surfaces.

25. The arrow of claim 24 further characterized in that the seal member has a plurality of slits that extend axially from the first surface toward the second surface, intersect adjacent to said central axis and extend at least predominently radially away from the intersection of the slits, the opposite end of the bore opening to the intersection of the slits.

26. The arrow of claim 24 further characterized in that the seal member includes a main body and closer means integrally joined to the main body for yielding when a needle point is pushed through said bore and toward the first surface to permit the needle point being extended into said chamber and resiliently returning to a fluid sealing position blocking fluid flow between the first chamber and the bore when the needle point is withdrawn through the bore.

27. The arrow of claim 26 further characterized in that said closure means is defined by a slit that is generally U-shaped in transverse cross section and extends axially from the first end surface toward the second end surface to provide spaced closure edge portions and a closure web edge portion that intersects said bore adjacent to the bore opposite end along the web edge portion and extends between said spaced closure edge portions.

* * * * *

UNITED STATES PATENT AND TRADEMARK OFFICE

CERTIFICATE OF CORRECTION

PATENT NO. : 4,541,636

DATED : September 17, 1985

INVENTOR(S) : Stanley A. Humphrey

It is certified that error appears in the above-identified patent and that said Letters Patent are hereby corrected as shown below:

Column 10, line 25, after "claim", insert --1--; Column 11, line 14, change "sea" to --seal--; and Column 12, line 22, change "th" to --the--.

Signed and Sealed this

*Tenth* Day of *December 1985*

[SEAL]

*Attest:*

DONALD J. QUIGG

*Attesting Officer*

*Commissioner of Patents and Trademarks*